US005959496A

United States Patent [19]

Parker

[11] Patent Number: 5,959,496

[45] Date of Patent: Sep. 28, 1999

[54] MICROPROCESSORS WITH EMISSION CONTROL

[75] Inventor: Terry Lee Parker, Versailles, Ky.

[73] Assignee: Lexmark International, Inc., Lexington, Ky.

[21] Appl. No.: 08/105,244

[22] Filed: Aug. 12, 1993

[51] Int. Cl.[6] ..... G06G 7/12

[52] U.S. Cl. ..... 327/560; 327/403; 327/306

[58] Field of Search ..... 307/242, 243, 307/244, 493; 328/103, 104, 105, 152, 153, 154; 327/306, 355, 403, 407, 415, 560; 340/870.16

[56] References Cited

U.S. PATENT DOCUMENTS

| | | | |
|---|---|---|---|
| 4,066,919 | 1/1978 | Huntington | 307/242 |
| 4,243,890 | 1/1981 | Miller et al. | 250/551 |
| 4,567,385 | 1/1986 | Falater et al. | 307/242 |
| 4,581,725 | 4/1986 | Pilarcik, Jr. | 307/493 |
| 4,845,390 | 7/1989 | Chan | 307/603 |
| 5,061,861 | 10/1991 | Sameshima et al. | 307/244 |
| 5,118,970 | 6/1992 | Olson et al. | 307/242 |
| 5,158,540 | 10/1992 | Boudry | 307/242 |
| 5,162,672 | 11/1992 | McMahan et al. | 307/242 |

FOREIGN PATENT DOCUMENTS

| | | | |
|---|---|---|---|
| 5-259767 | 10/1993 | Japan | 307/493 |

*Primary Examiner*—Terry D. Cunningham
*Attorney, Agent, or Firm*—John A. Brady

[57] ABSTRACT

A microprocessor (9) has output driver circuitry (20 FIG. 1; 30, 32 FIG. 2) which is selectable by signals on electrical lines (22 FIG. 1; 36 FIG. 2) to obtain different drive levels. In this manner mass produced microprocessors may be employed with output voltage selected to better match load and thereby reduce electrical noise from overshoot and ringing. Typically, each microprocessor when installed in a printer (1) or other apparatus will be selected to only one such status during the life of the apparatus.

3 Claims, 2 Drawing Sheets

MICROPROCESSORS WITH EMISSION CONTROL

TECHNICAL FIELD

This invention relates to the design of data processors on a single substrate, generally known as microprocessors or computers on a chip. In accordance with this invention the microprocessor is configured to reduce electromagnetic emissions in various applications.

BACKGROUND OF THE INVENTION

Suppression of undesired electromagnetic emissions is a continuing design object because of the large and growing number of machines and appliances used which employ electronic circuitry which produces such noise. In the United States and other countries, government regulations strictly limit the emissions of commercial products. U.S. Pat. No. 4,243,890 to Miller et al is of some general interest in this respect in that it discusses control of electromagnetic signals.

It is widely understood that matching drive power to the load being driven reduces such undesirable emissions. Some custom chip manufacturers provide chips in which the drivers are specified to match the load of the intended use. Such selection must be designed into the chip and can not be changed later.

The great majority of microprocessors employed in commercial applications such as personal computers, printers, and other modern devices having controllers are entirely standard, such as, for example, the 386 microprocessors sold in large number by Intel Corp. and Advanced Micro Devices, Inc. These provide output drive signals of a single level of electrical potential which is high enough to be effective with most apparatus which might be driven. When such conventional microprocessor drives lesser loads than can be supported by the driver, the currents on the bus within the microprocessor and on the line to the load are larger than is absorbed by the load and therefore build up (sometimes termed "overshoot"). This produces reflected current and oscillations on these conductors (sometimes termed "ringing"), which emit electromagnetic noise. Similarly, where the drive signal is too low, undershoot and ringing occur to produce electromagnetic noise.

DISCLOSURE OF THE INVENTION

In accordance with this invention, mass-produced microprocessors include output-driver elements to provide different output voltage levels under control of a signal to the microprocessor. These may be separate, parallel drivers, each having an enable input line for selection of only one of them. These may be a series of drivers with each stage amplifying the signal from the previous stage, each having a select input line which causes that stage to merely pass the received signal.

Typically a chip in accordance with this invention when installed in an electronic apparatus, such as a printer, will receive only one selection status to select one drive level for the life of the apparatus. In certain specialized applications, the apparatus might have different operating modes for which different drive levels are selected.

Electronic noise from emission are reduced by the drive level being better matched to the optimum requirements of the load.

BRIEF DESCRIPTION OF THE DRAWING

The details of this invention will be described in connection with the accompanying drawing, in which.

BEST MODE FOR CARRYING OUT THE INVENTION

Figure 1:
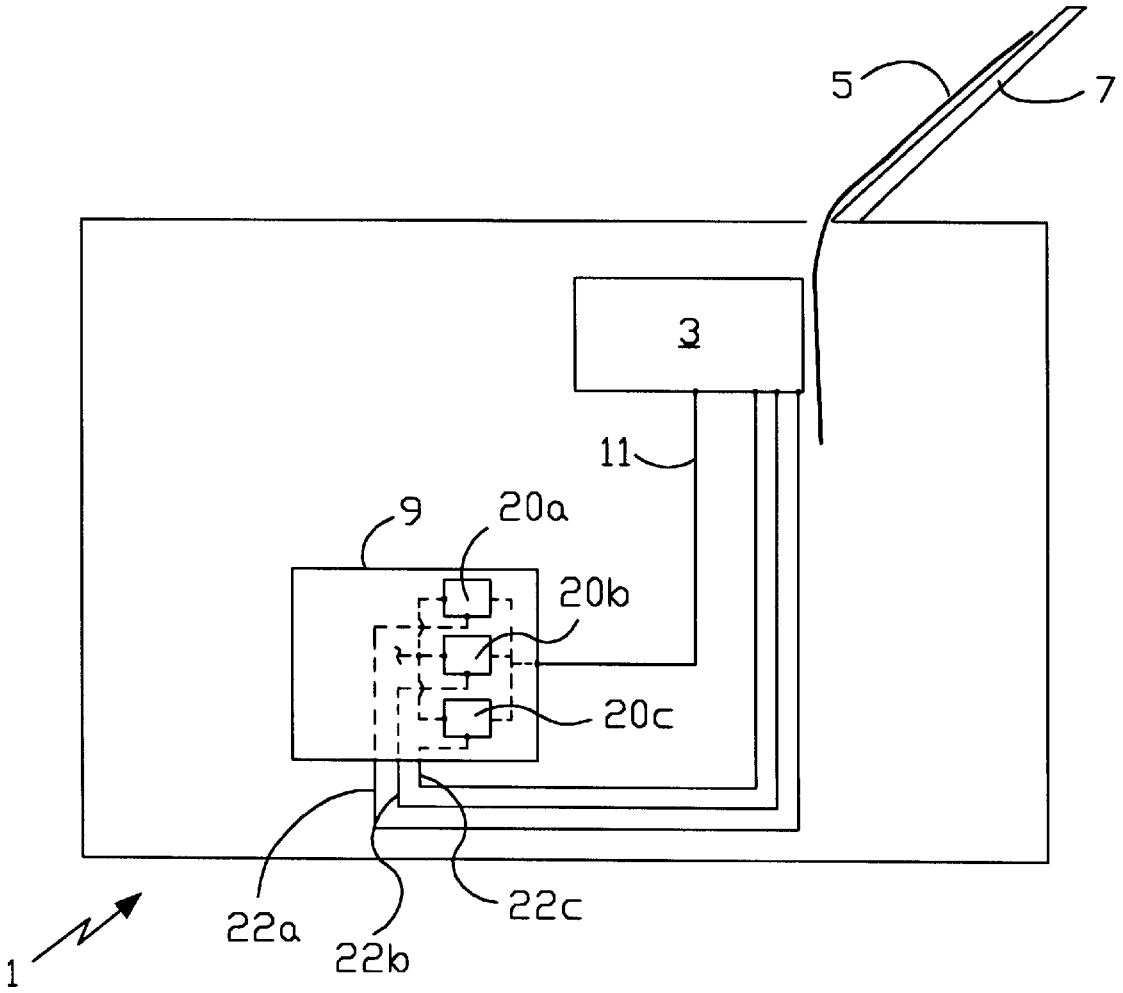
FIG. 1 is illustrative of a microprocessor design in a printer in which one of three output drivers can be selected and FIG. 2 is illustrative of a microprocessor design in a printer in which one or both of two driver stages in series can be selected.

This invention is illustrated in a printer 1 having printing mechanism 3, which may be entirely conventional, which applies an image to paper 5 and then delivers paper 5 to an output tray 7.

As is true for modern printers, the operation is controlled by a microprocessor 9, which communicates with the printing mechanism 3 by electrical line 11. To the extent that the signal on line 11 is overdriven or underdriven, undesirable electrical noise results. In accordance with the embodiment of FIG. 1, microprocessor 9 has three separate output driver circuits, 20*a,* 20*b* and 20*c,* each having different levels of output. They are connected in parallel to line 11. Each may be selected by a signal to an enable port 22*a,* 22*b* and 22*c* specific to the drivers 20*a,* 20*b* and 20*c* respectively. Typically, the printing mechanism 3 will produce a signal on one of the lines 22*a,* 22*b* or 22*c* during all times when printing 1 is operative, the line 22*a,* 22*b* or 22*c* selected enabling the corresponding driver 20*a,* 20*b* and 20*c* which has output voltage characteristics best matching the requirements which line 11 services.

Figure 2:
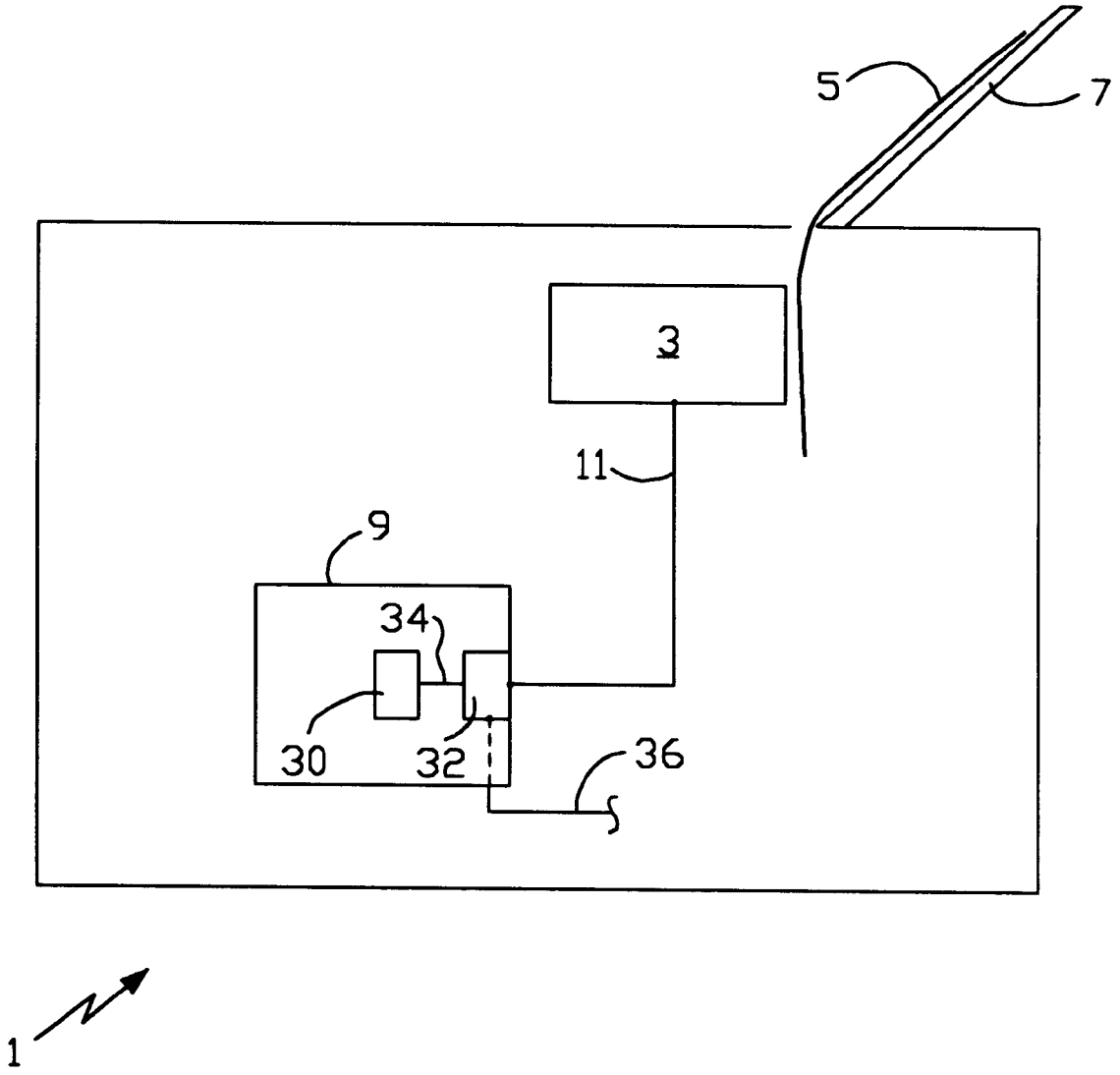

The FIG. 2 embodiment differs from the FIG. 1 embodiment in that it has two driver stages 30 and 32 with the output of stage 30 connected by an electrical line 34 as the input of stage 32. When enabled by an enable signal on line 36, stage 32 amplifies the signal from line 30. When not enabled, stage 32 merely passes the signal of stage 30 to line 11. Line 36 is connected to the printer mechanism 3 and driven with an enable signal during operation when the requirements which line 11 services need a high level signal. In a different printer, where the best match with line 11 is the low level signal, line 36 does not carry an enable signal, and the lower level signal of stage 30 is merely passed through stage 32 to line 11.

With the matching of the drive from microprocessor 9 to the requirements of line 11, electromagnetic noise is significantly reduced and minimized.

The invention may be implemented in a large variation of embodiments. The control lines 22*a,* 22*b,* and 22*c* or 36 can come from a register under software control for added flexibility or for reduction of input/output terminals on the microprocessor. In typical application, such as the printer shown, the driver circuitry is selected to only one status during all operation of the printer.

What is claimed is:

1. Electronic apparatus comprising mechanical mechanism, a microprocessor to control said mechanical mechanism, said microprocessor being on a single substrate and having an output driver on said substrate to apply control signals generated by said microprocessor to an electrical line connected to control said mechanism, said output driver having at least one circuit which is selectable from an electrical signal to said one circuit on an enable line to select a first output voltage level of said output driver when said one circuit is selected and to select a second output voltage level lower in voltage level than said first output voltage level when said one circuit is not selected, said enable line being connected to a signal originating in said electronic apparatus to select only one of said first output voltage level or said second output voltage level during all normal operations of said apparatus.

2. Electronic apparatus as in claim 1 in which said at least one circuit comprises at least two different circuits connected in parallel to provide the output of said output driver, each of said two circuits being selectable from a different electrical signal on an enable line to each of said two circuits respectively, and providing said first output voltage level when said enable line to a first of said two circuits is selected by said signal originating in said electronic apparatus and said second output voltage level when said enable line to a second of said two circuits is selected by said signal originating in said electronic apparatus.

3. Electronic apparatus as in claim 1 in which said at least one circuit comprises a first driver circuit, the output of which is connected to a second driver circuit, the output of said second driver circuit providing the output of said output driver, said second driver circuit being selectable by said signal originating in said electronic apparatus to amplify the output from said first driver circuit when selected and to pass the output from said first driver circuit when not selected.

* * * * *